United States Patent [19]

Cramer et al.

[11] Patent Number: 4,520,850

[45] Date of Patent: Jun. 4, 1985

[54] APPARATUS IN A SHUTTLELESS WEAVING MACHINE FOR MAKING A SELVAGE

[75] Inventors: Gottfried Cramer, Lindau; Valentin Krumm, Hergensweiler, both of Fed. Rep. of Germany

[73] Assignee: Lindauer Dornier Gesellschaft mbH, Lindau, Fed. Rep. of Germany

[21] Appl. No.: 538,905

[22] Filed: Oct. 4, 1983

[30] Foreign Application Priority Data

Nov. 3, 1982 [DE] Fed. Rep. of Germany ..... 3240569

[51] Int. Cl.[3] ..... D03D 41/00

[52] U.S. Cl. ..... 139/194; 139/302; 139/429

[58] Field of Search ..... 139/429, 430, 434, 188 R, 139/190, 194, 302, 303

[56] References Cited

U.S. PATENT DOCUMENTS 3,461,920 8/1969 Sakamoto ..... 139/302

3,998,249 12/1976 Pfarrwaller ..... 139/302

4,296,783 10/1981 Ichimatsu ..... 139/194

*Primary Examiner*—Henry S. Jaudon

*Attorney, Agent, or Firm*—W. G. Fasse; D. H. Kane, Jr.

[57] ABSTRACT

The auxiliary warp threads required in a shuttleless weaving machine to form a detachable catch selvage are guided through a special auxiliary reed. In the rest position, the auxiliary reed is positioned tightly against the main reed. The auxiliary reed is so guided in its motion that, in addition to the conventional beat-up motion coupled to the main reed, it also performs an additional displacement directed laterally outwards. As a result, a cutting strip is formed between the fabric and the catch selvage. The projecting filling ends held by the auxiliary warp threads are drawn into the catch selvage during this step. The length of filling yarn required for the cutting strip is drawn from the edge waste projecting over the catch selvage and therefore the waste in filling yarn is reduced by the size of the cutting strip width.

8 Claims, 3 Drawing Figures

APPARATUS IN A SHUTTLELESS WEAVING MACHINE FOR MAKING A SELVAGE

FIELD OF THE INVENTION

The invention relates to an apparatus in a shuttleless weaving machine for forming a selvage with projecting filling yarns. The yarn ends of the filling yarns or fillings entered into the shed are placed between auxiliary warp threads of a severable catch selvage. The auxiliary warp threads extend at a lateral spacing from the fabric warp threads and hold the yarn ends.

DESCRIPTION OF THE PRIOR ART

Several means are known in weaving on shuttleless machinery to form a selvage. One possibility is the so-called catch or auxiliary selvage. This selvage is present in a shuttleless weaving machine either unilaterally only, that is on the filling yarn draw-out side, or bilaterally, that is on both the insertion and draw-out sides. Where such a catch selvage is involved, a number of auxiliary warp threads are additionally arranged to the side and outside the main warp threads of the fabric proper. The auxiliary warp threads also are subjected to a shed motion and the filling yarn is placed by its free end between these auxiliary warp threads, then seized by them and kept in place. In this manner a narrow auxiliary strip of fabric is woven, the sole purpose of which is to hold the filling yarn, or to catch it and to prevent any recoil of the filling yarn end. This auxiliary fabric strip or catch selvage subsequently is severed from the fabric proper. Such selvage formation using a catch selvage is known for instance from German Patent Publication No. 2,121,430.

Embodiments of known catch selvages differ from one another, for instance there are separately binding sets of threads, principally in the most common basic weaves, as well as lenos and several leno groups next to one another. To allow separation of these catch selvages from the fabric, a cutting spacing must be provided between the edge of the fabric and the catch selvage, that is, the respective elements forming the catch selvage are arranged at such a distance from the last warp thread of the basic fabric or its leno threads that the auxiliary or catch selvage can be reliably cut off.

U.S. Pat. No. 2,906,296 discloses another type of selvage formation. In this instance auxiliary warp threads also are provided outside and at a spacing from the fabric for the purpose of holding the projecting ends of the filling yarns. Contrary to the case of the above cited German Patent Publication No. 2,121,430, the auxiliary warp threads are not woven into an auxiliary fabric strip but, rather, every single filling yarn drawn in between the auxiliary warp threads and held there will be drawn out again from the auxiliary warp threads, after the reed beat-up, by a lay-in needle bent over at the selvage and inserted into the next loom shed. The auxiliary warp threads continue to run idly. Therefore, this system does not require any special separation of the auxiliary threads from the fabric using scissors or the like.

Depending upon the type of weaving machine used, a separate auxiliary reed for the auxiliary warp threads is used during the beat-up of the filling yarn, or the basic reed is made longer by the required amount. The projecting end of the filling yarn in any event extends from the edge of the fabric across the width of the cutting spacing, the width of the catch selvage, the inevitable spacing between the outermost auxiliary warp thread and the tip of, that is the clamping means of, the retracted filling yarn insertion device, and furthermore across the residue necessarily projecting beyond the clamping means. Depending upon the fabric which must be woven and the necessary cut length of the yarn ends at the fabric edge, the distance from the fabric edge to the catch selvage will differ. Together with the above-mentioned widths or spacings, this distance represents a substantial waste of filling yarn. This is also the case when the projecting yarn end is cut off and laid into the fabric edge or selvage.

In a machine of the type disclosed in the German Patent Publication No. 2,121,430, this waste of filling yarn is cut off together with the auxiliary warp threads, both going to waste. In U.S. Pat. No. 2,906,296, the yarn ends laid-in at the fabric edge are so long that they are drawn out again by the lay-in needle to a substantial proportion to project as bristles from the fabric surface so that they must be cut off later. In addition to the appearance of the fabric surface being impaired at the sites where the yarn ends are cut off, there is also a substantial waste in filling yarn in this case because a relatively short filling yarn end about the width of the cutting spacing would suffice for a laid-in selvage.

Considered individually, the length of the waste in filling yarn might not be significant, but in the light of the overall production it causes losses which add up to a very substantial sum per year for each weaving machine. Therefore, it is the object of the invention to substantially reduce this waste in filling yarn.

SUMMARY OF THE INVENTION

In the present invention, the cutting spacing is formed only when the reed beat-up takes place and, accordingly, it is possible to save the width of the cutting spacing during the actual filling insertion and when holding the yarn end in the auxiliary warp threads of the catch selvage. The required length of the filling yarn for the cutting strip will therefore be drawn, during the lateral motion of the auxiliary reed, out of the edge waste in the catch selvage projecting out of the catch selvage.

The lateral displacement of the auxiliary reed further makes it possible to select an earlier time for the crossing of the catch selvage and moreover this lateral displacement makes the filling yarn taut in the area of the selvage. The effect thus achieved also makes it possible to open earlier the clamping means of the filling yarn insertion device retracting the filling from the shed, whereby again the waste in filling yarn can be reduced, without thereby running the risk of obtaining filling yarns that are too short, or that there will be loose selvages.

The principle of the invention also can be applied when operating without catch selvages, the function of the catch selvages being performed by another fastening means, for instance a clamp. This fastening means can be displaced similarly to the catch selvage. The principle of the invention furthermore applies if, for instance, the yarn is held by an air nozzle. In each case, the invention offers a substantial reduction in filling yarn waste while simultaneously increasing the useful draw-in width.

BRIEF DESCRIPTION OF THE DRAWINGS

The invention will be further illustrated, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
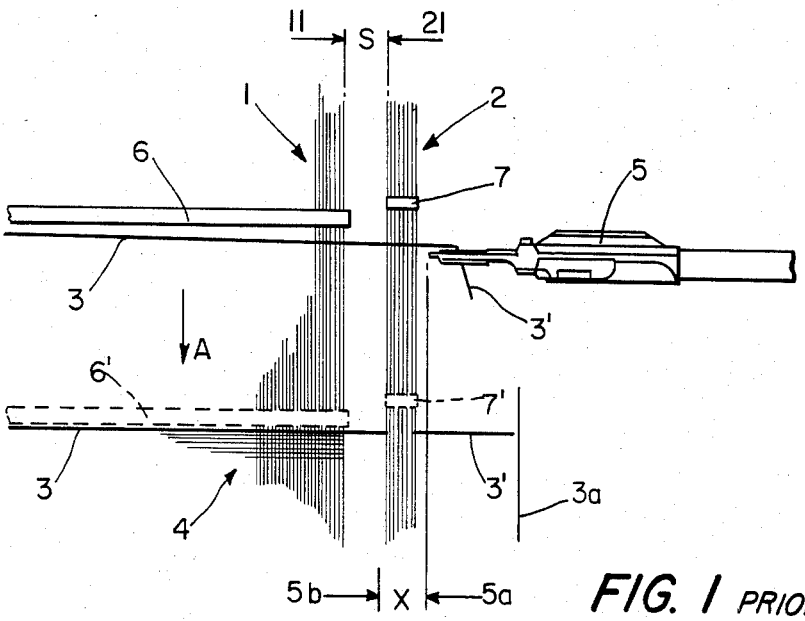
FIG. 1 PRIOR ART
FIG. 1 shows schematically a top view of a conventional arrangement of a catch selvage.

FIG. 1 is a schematic top view of the conventional arrangement of a catch selvage. A number of warp threads 1 is indicated. The outermost warp thread 11 is located at the fabric edge. The warp threads 1 are guided by a reed 6 shown schematically. Auxiliary warp threads 2 including an innermost warp thread 21 are located at a spacing S away from the warp thread 11 and are guided by an auxiliary reed 7. An inserted filling yarn 3 is indicated in the drawing below the reed 6 while still being held by the filling insertion device, for instance a gripper 5. A short end 3' of the filling yarn projects beyond the clamping means of the gripper 5. The finished fabric 4 is merely shown symbolically.

The beat-up motion of the reed 6 is indicated by an arrow A. The reed in that case will be in its beat-up position 6' shown by dashed lines. Correspondingly, the auxiliary reed 7 is moved together with the reed 6 into its position 7'. The taut filling yarn end 3' extends as far as the limit line 3*a*. The spacing S between the fabric 4 and the catch selvage acts as a cutting spacing for severing the catch selvage.

Figure 2:
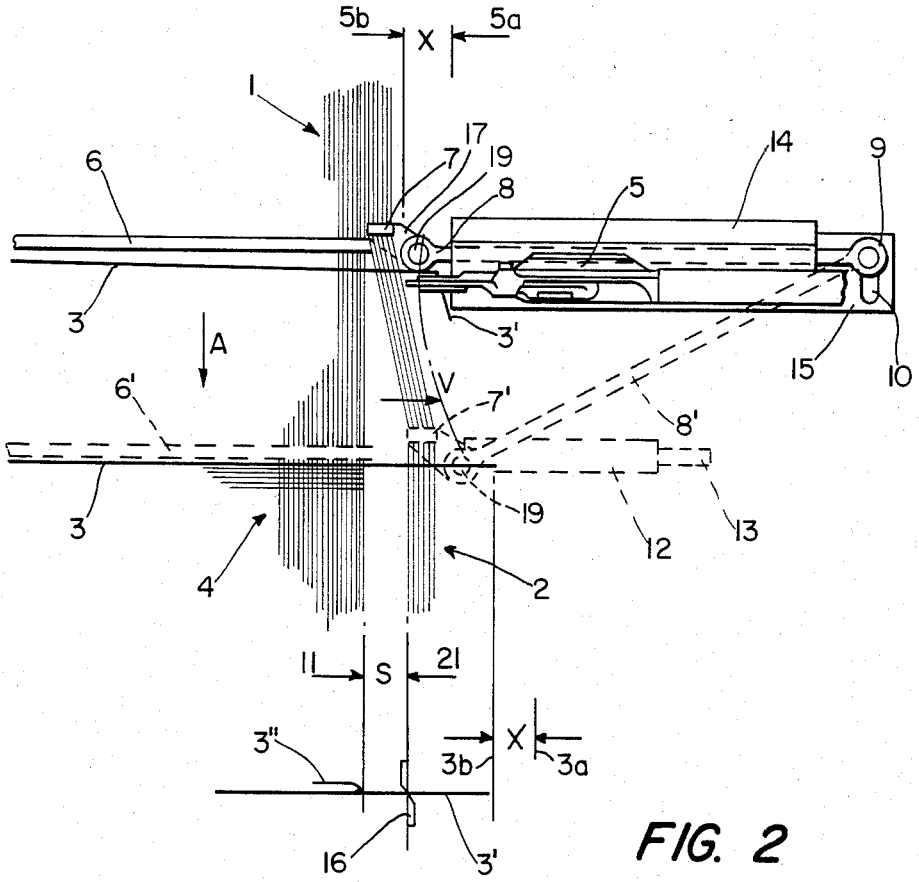
FIG. 2 shows a top view of the arrangement of the catch selvage of the present invention.

FIG. 2 shows the same arrangement as FIG. 1 for the apparatus of the invention. The same draw-in width is assumed but, contrary to FIG. 1, the auxiliary reed 7 in this instance is located tightly against the reed 6 and the two warp threads 11 and 21 of the fabric and catch selvage respectively are tightly positioned against each other. Initially, there is not cutting spacing. The filling insertion device, that is the gripper 5, in this instance is withdrawn to an extent smaller than in FIG. 1, that is just a little behind the outer limit of the catch selvage 2 when the latter is in its inside position. During the beat-up motion A the auxiliary reed 7 no longer is displaced parallel to the basic reed 6 but, rather, it is additionally moved laterally in the direction of the arrow V whereby the auxiliary warp threads 2 are moved away from the fabric warp threads 1. Again the beat-up position is indicated by dashed lines and by 6' and 7', respectively. The above-mentioned outermost warp thread 11 of the fabric and the innermost auxiliary warp thread 21 of the catch selvage are now spaced to form the cutting spacing S. During the combined beat-up motion A and the displacement V, the end 3' of the filling yarn is elastically clamped between the auxiliary warp threads 2 of the catch selvage and is pulled through by these threads. In this instance, the taut and straight end 3' of the filling yarn extends only as far as the line 3*b*. The distance X between the lines 3*a* and 3*b* corresponds approximately to the cutting spacing S and is present again in the spacing between the limit lines 5*a* and 5*b* of the front edge of the retracted filling insertion device 5.

The lower end of FIG. 2 again shows a single filling yarn having an end 3' extending only to the limit line 3*b*. Scissors 16 are mounted approximately next to the inner auxiliary warp thread 21. The scissors jointly cut the short end 3' of the inserted filling yarn and the catch selvage 2. The remaining yarn at the fabric edge may be laid-in in known manner in the fabric. This possibility is indicated by 3''. The length of the yarn end 3'' corresponds to the width of the cutting spacing S and is entirely adequate for a laid-in selvage.

The lateral displacement of the auxiliary reed 7 between its positions 7 and 7' may be implemented in different ways. For instance, the auxiliary reed 7 can be carried along by the basic reed 6 by being laterally displaced in a spatially fixed guide groove or the like. In the example of FIG. 2, the auxiliary reed 7 is mounted to an arm 17 of a reed mounting foot 18. The arm 17 is connected in a hinged manner by a journal bearing 19 to a pivot arm 8. The pivot arm 8 is pivotally mounted in a bearing 9 fixed to the machine frame not shown. The baring 9, for instance, may be operatively held by a fastening member 15 which also carries a gripper guide 14. The fastening member 15 is conventionally mounted in the machine frame. During the reed beat-up, the pivot arm 8 is pivoted by a control means (not shown) into its position 8' shown by dashed lines, whereby the auxiliary reed 7 undergoes a lateral displacement with respect to the reed 6. The reed mounting foot 18 of the auxiliary reed 7 is mounted in a displaceable manner in a reed holder 12. The reed holder 12 in turn is rigidly secured to a reed stay 11*a* shown by dash-dotted lines in FIG. 3. The reed stay 11*a* also supports the reed 6. Therefore, the reed 6 and the reed holder 12 are jointly displaced during the beat-up motion A into the position shown by dashed lines in FIG. 2. The additional lateral displacement V takes place in a direction parallel to the reed 6 by means of the guide pins 13 sliding through the reed holder 12 which thus holds the guide pins 13 in a movable manner.

As indicated by an elongated slot 10 in the fastening member 15, the position of the bearing 9 can be moved approximately parallel to the warp threads, or also if desired, transversely thereto, in a continuous manner whereby the bearing 9 may be displaced in the slot 10 when a bearing mounting nut 23 is loosened and, after adjustment is fastened again. As a result, the displacement of the arm 8 to position 8', and hence the size of the cutting spacing S, is adjustable depending upon need and the requirements set by the machine and the weaving.

As shown in FIG. 2, the auxiliary reed 7 is mounted on the foot 18 tightly against or even partially behind the reed 6. The adjustability of the position of the bearing 9 makes it possible to guide the auxiliary reed 7 partially in an arc around the tip of the gripper 5, which is an advantage for the operation of the apparatus of the invention.

It is not significant for the invention whether the lateral displacement begins in the rear position of the auxiliary reed 7 or only during the reed beat-up. The curved path of the displacement can be selected entirely as required. Without impairing open-shed weaving, the filling insertion device 5 can be brought as close as X to the fabric.

Figure 3:
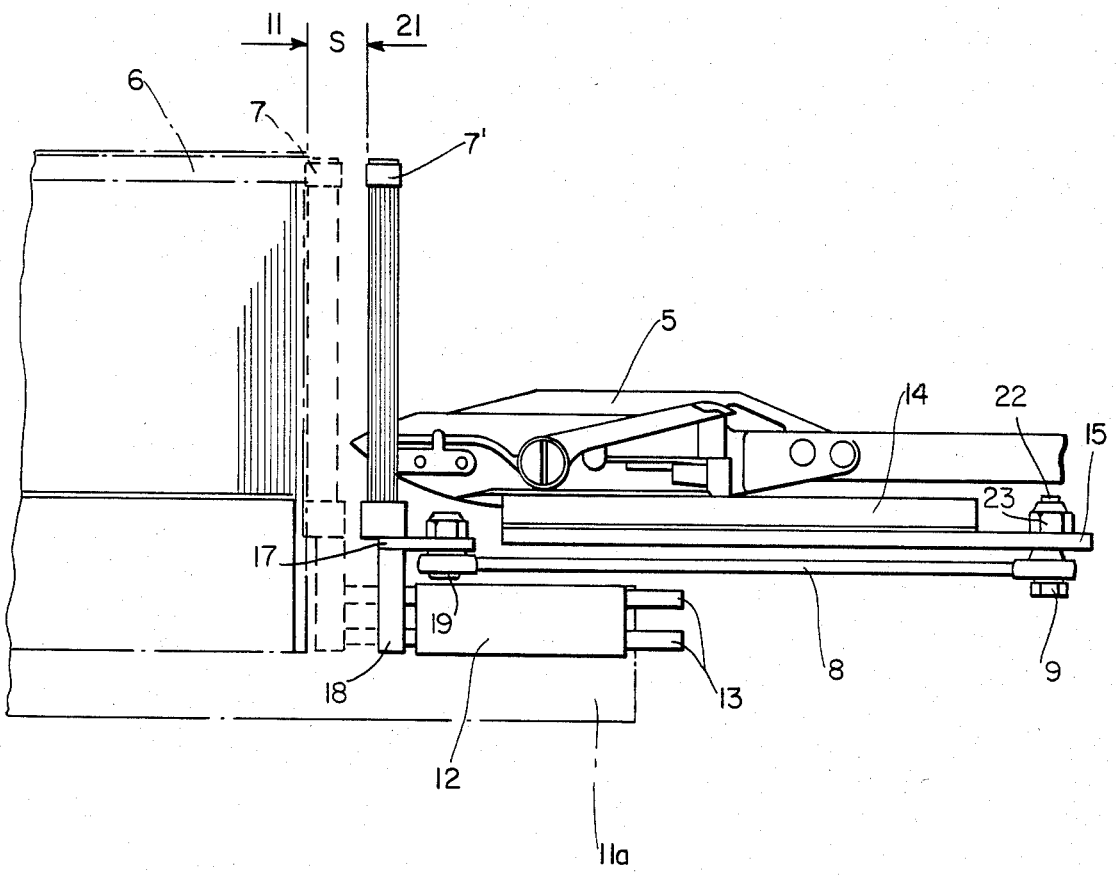
FIG. 3 shows a side view of the arrangement of the present invention.

FIG. 3 is a somewhat enlarged side view relating to FIG. 2. The reed stay 11*a* supports the reed 6 and the reed holder 12. The auxiliary reed is shown both in its rear position 7 and in its beat-up position 7'. FIG. 3 shows that the auxiliary reed 7 is displaceable parallel to the reed stay 11*a* and hence also parallel to the basic reed 6 by means of the guide pins 13 slidably held in the reed holder 12.

The machine-mounted fastening member 15 supports the gripper guide 14, of known construction and therefore not further discussed, for the gripper 5 which is the filling yarn inserting device. The bearing 9 supporting the pivot arm 8 is adjustable in its position in the fastening member 15 by the nut 23 on a support bolt 22 for the bearing 9. The other end of the pivot arm 8 is connected in a hinged manner by the bearing 19 to the auxiliary reed 7 as mentioned above.

FIG. 3 clearly shows the effect of the invention in that the auxiliary reed when in its position 7' covers the tip of the filling yarn insertion device 5 and thereby provides for shortening the waste.

The same width of draw-in was assumed in the comparison of FIGS. 1 and 2 and the shortening of waste possible was indicated by the distance X. The advantage of the invention also can be obtained in such a manner that the width of draw-in is increased practically by the extent of the reduction in waste.

It will be appreciated by those skilled in the art that many modifications may be made within the scope of the present invention without departing from the spirit thereof, and the invention includes all such modifications.

What we claim is:

1. In an apparatus in a shuttleless weaving machine for forming in a fabric, a selvage with projecting filling yarns, where the ends of said filling yarns inserted into a shed by a filling yarn insertion device, are laid into a fastener means mounted at a lateral spacing from warp threads of the fabric, said fastener means holding said filling yarns and where subsequently the filling yarns are beaten against the fabric by a reed performing a beat-up motion, the improvement comprising first means coupling said fastener means (2) to said beat-up motion of said reed (6), and second means whereby at beat-up (A) of said filling yarn (3) said fastener means are additionally displaceable along a displacement path in a lateral direction (V) from a rest position tightly against said reed (6), whereby a spacing (S) is formed between the fabric (4) and the fastener means (2).

2. The apparatus according to claim 1, in which the displacement path of the fastener means (2) envelops in a partially arcuate form a tip of said filling yarn insertion device (5) outside the shed and in the end position of said filling yarn insertion device (5).

3. The apparatus according to claim 1, further comprising means for elastically clamping therein ends (3') of said filling yarns held by said fastener means (2) in the longitudinal direction thereof during a beat-up motion (A).

4. The apparatus according to claim 1, wherein said fastener means (2) comprise a detachable catch selvage passing laterally off of the warp threads (11) and formed by auxiliary warp threads (21) subject to a shed displacement, said apparatus further comprising a separate auxiliary reed (7) guiding said auxiliary warp threads (21) of the catch selvage (2), and means operatively connected to said auxiliary reed (7) for additionally and laterally (V) displacing said auxiliary reed from the rest position thereof tightly against the reed (6) during the beat-up motion (A) of said reed (6) in a manner such that thereby said spacing (S) is produced between the fabric (4) and the catch selvage (2), said spacing (S) providing access for cutting.

5. The apparatus according to claim 4, wherein said displacing means comprise means connecting said auxiliary reed (7) to said reed (6), and machine mounted guide means for guiding said auxiliary reed (7) when it is being laterally displaced.

6. The apparatus according to claim 4, wherein said displacing means comprise an arm (8), a machine mounted bearing (9) operatively securing said arm (8) to said apparatus and means operatively mounting said auxiliary reed (7) to said arm (8) for pivotal displacement during a beat-up motion (A).

7. The apparatus according to claim 6, further comprising movable guide means whereby said auxiliary reed (7) is displaceable within said movable guide means (12, 13) extending in parallel to said reed (6), said movable guide means being movable with said reed (6).

8. The apparatus according to claim 6, further including means whereby the position of said machine mounted bearing (9) is continuously adjustable.

* * * * *